United States Patent [19]

Hoetzl

[11] Patent Number: 4,527,506

[45] Date of Patent: Jul. 9, 1985

[54] APPARATUS FOR COOLING A STRIP PRIOR TO A MINISPANGLE OPERATION

[75] Inventor: Max Hoetzl, Toledo, Ohio

[73] Assignee: Midland-Ross Coporation, Cleveland, Ohio

[21] Appl. No.: 588,646

[22] Filed: Mar. 12, 1984

[51] Int. Cl.[3] ..... C23C 1/02

[52] U.S. Cl. ..... 118/63; 118/69; 118/419; 239/455; 239/436; 427/398.1; 427/433

[58] Field of Search ..... 427/398.1–398.4, 427/433; 118/69, 63, 419; 239/455, 436

[56] References Cited

U.S. PATENT DOCUMENTS 3,756,844 9/1973 Bunnel ..... 118/69

4,158,070 6/1979 Lewicki ..... 118/69

*Primary Examiner*—Sam Silverberg

*Attorney, Agent, or Firm*—H. Duane Switzer

[57] ABSTRACT

A steel strip (10) is conveyed through a galvanizing bath (20) of molten zinc, a zinc coating weight control device (12), and a minispangle box assembly (16). The steel strip emerges from the zinc coating weight control device (12) with a non-uniform temperature distribution across its width in which it is warmer in the center and cooler at its edges. A differential, pre-cooler assembly (18) cools the steel strip selectively and non-uniformly across its width in a manner which is complimentary to the temperature distribution thereacross. In this manner, the steel strip exits the pre-cooler assembly (18) and enters the minispangle box assembly (16) with a more uniform temperature distribution. This results in a more uniform minispangle appearance on the strip (10) as it exits the minispangle box assembly (16). The pre-cooler assembly includes a plurality of nozzle pairs (32*a*, 32*b*; 34*a*, 34*b*; 36*a*, 36*b*; 38*a*, 38*b*). The nozzles of each nozzle pair are disposed in a facing relationship on opposite sides of a work path, and include a pair of conduits (60*a*, 60*b*) which define an array of apertures (62*a*, 62*b*) therealong. A damper (66*a*, 66*b*) is provided to selectively cover the apertures in each array. Each damper has a leading edge (72*a*, 72*b*) which is somewhat U-shaped so that as the damper is adjusted relative to the associated conduit, the apertures of the array are progressively covered from the outer edges toward the center, or progressively uncovered from the center toward the edges.

9 Claims, 6 Drawing Figures

APPARATUS FOR COOLING A STRIP PRIOR TO A MINISPANGLE OPERATION

BACKGROUND OF THE INVENTION

The present application relates to the art of metal processing. The invention finds particular application in conjunction with cooling strip steel after immersion in a galvanizing bath and in preparation for minimizing the spangle size of the steel coating. This invention will be described with particular reference thereto. It is to be appreciated, however, that the invention is also applicable to other strip handling systems in which selective cooling across the strip width is advantageous.

Conventionally in preparation for minispangling, hot strip steel is dipped into a bath of molten zinc. The excess zinc is wiped off the steel by a coating weight control device, and then the steel and coating are allowed to cool naturally in air or are uniformly cooled by forced air coolers. In many cases the strip steel and coating are not a uniform temperature across the width of the strip. This non-uniform temperature is a result of many factors such as variations in steel strip and coating thicknesses, the natural tendency of the strip edges to cool faster than the center of the strip, non-uniform cooling by the coating weight control device and non-uniformities in thermal treatments of the strip prior to the galvanizing bath. When the steel strip and coating temperature are not uniform across the strip prior to entry into the minispangle box, the minispangle coating appearance will be non-uniform. In this case, one area of strip may have minimized spangles and another area will have partially reduced or full size spangles (irregular shaped crystals) as seen on regular galvanized steel strip.

The present invention contemplates a new and improved differential pre-cooling apparatus which selectively provides non-uniform cooling across the strip width to compensate for inherent uneven steel strip and coating temperatures.

SUMMARY OF THE INVENTION

In accordance with a first aspect of the invention, a new minispangling apparatus is provided. A conveying means conveys a continuous strip of hot steel through a galvanizing bath of molten zinc and a coating weight control device. A minispangle box is conventionally disposed downstream from the coating weight control device. The coating weight control device and the natural cooling area upstream of the minispangle box have a tendency to cool the strip steel unevenly across its width, most commonly cooling the strip more rapidly adjacent its edges. In cases where additional cooling of the steel strip and coating are required, a pre-cooler assembly is disposed between the coating weight control device and the minispangle box. The present invention includes nozzle means for causing air to flow against the strip across its transverse width. A nozzle restricting means restricts air flow through the nozzle means selectively and non-uniformly across the strip width. In this manner, the amount of air flow against the strip is selectively varied across the width such that the non-uniform cooling compliments the non-uniform temperature. This brings the strip to a generally uniform temperature across its width prior to entry in the minispangle box.

A first advantage of the present invention is the production of a minispangled surface appearance which is substantially uniform across the strip width.

Another advantage of the invention is that it selectively provides differential cooling across a strip width.

Another advantage of the invention is the selective adjustment of the temperature of a strip across its width for rendering the strip temperature substantially uniform.

Another advantage of the invention is fewer minispangle box adjustments, eg., height location, recirculation flow rate and zinc feed rate, are required to adjust to changing operating conditions such as line speeds, strip dimensions, coating weight thicknesses, and galvanizing bath temperatures.

Still further advantages of the present invention will become apparent to others upon a reading and understanding of the following detailed description of the preferred embodiment.

BRIEF DESCRIPTION OF THE DRAWINGS

The invention may take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
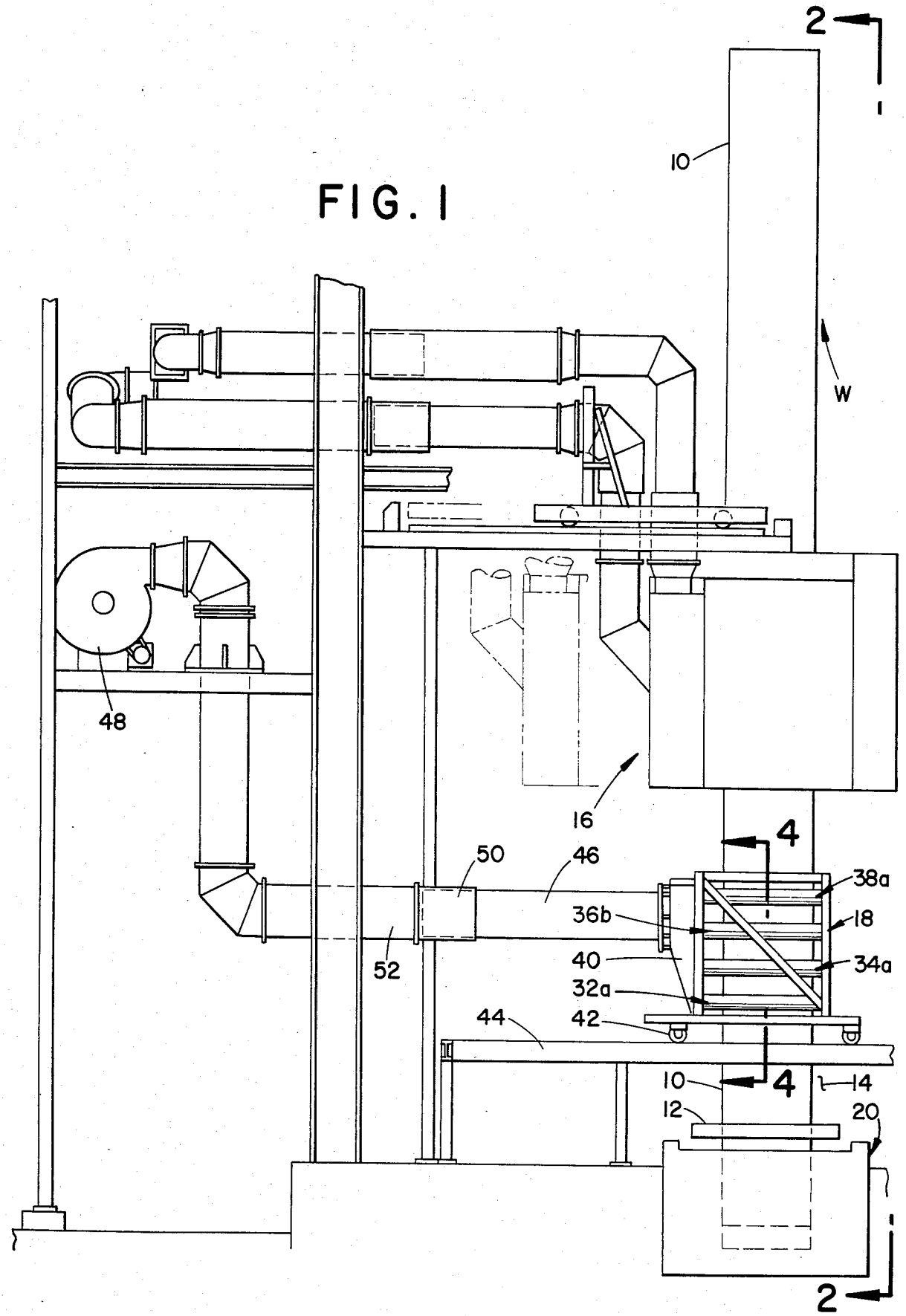
FIG. 1 is a front elevational view of a minispangling apparatus which includes the present invention and wherein the galvanizing bath, coating weight control device and minispangle box are shown diagrammatically for ease of illustration.
Figure 2:
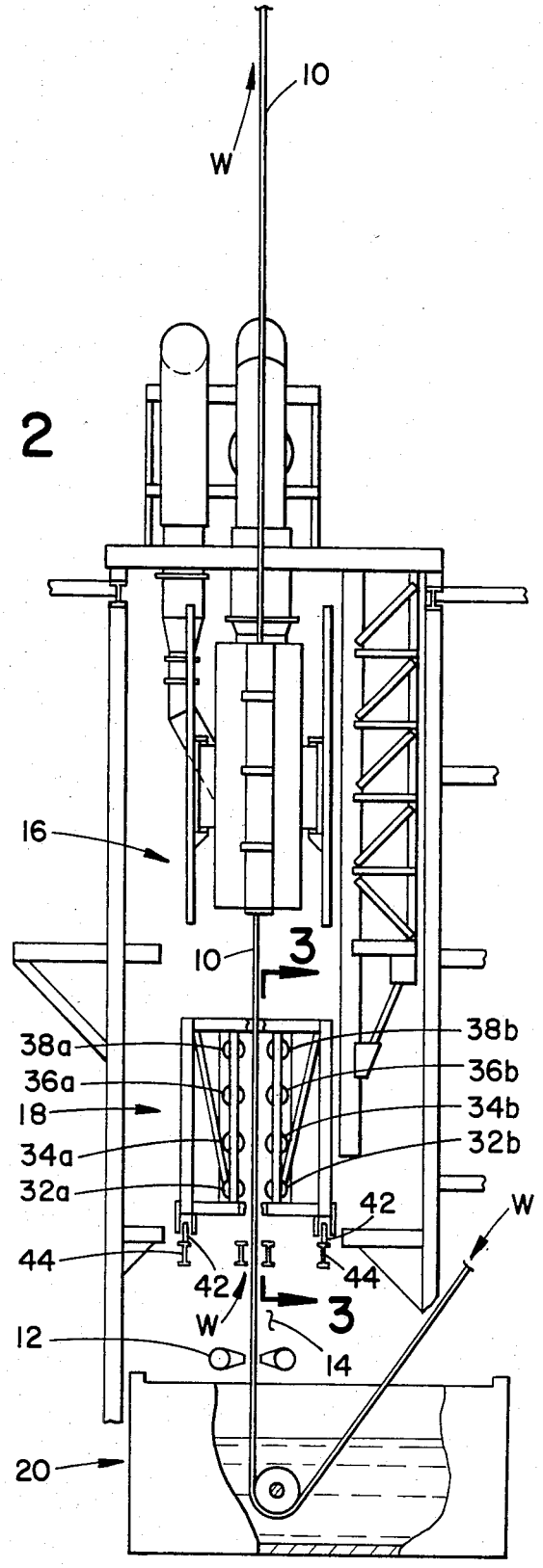
FIG. 2 is a side elevational view of the assembly of FIG. 1 in partial cross-section.

Referring now to the drawings, wherein the showings are for purposes of illustrating the preferred embodiment of the invention and not for limiting same, FIGS. 1 and 2 show a conveying means employed to convey strip steel 10 or a strip of other material to be treated along a work path W through a galvanizing bath of molten zinc 20, coating weight control device 12, and a natural cooling area 14. The strip steel exits the natural cooling area with a non-uniform temperature across the strip width.

A differential pre-cooler assembly 18 adjacent the minispangle box cools the strip steel non-uniformly across its width in a manner which is complimentary to the temperature distribution thereacross such that the strip steel exists the pre-cooler assembly with a generally uniform temperature. The conveying means conveys the strip steel with uniform temperature from the pre-cooling assembly to the minispangle box. The minispangle box cools the strip further and creates a uniform minispangle appearance on the coating.

Figure 4:
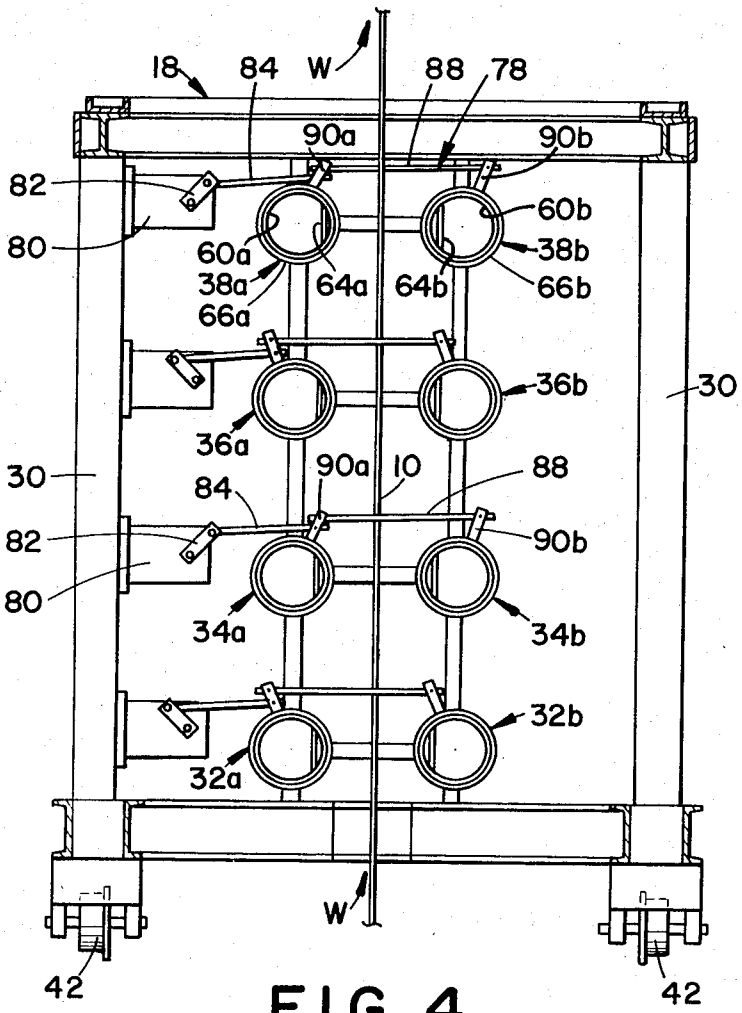
FIG. 4 is an enlarged cross-sectional view of the pre-cooling assembly taken along lines 4—4 of FIG. 1.
Figure 3:
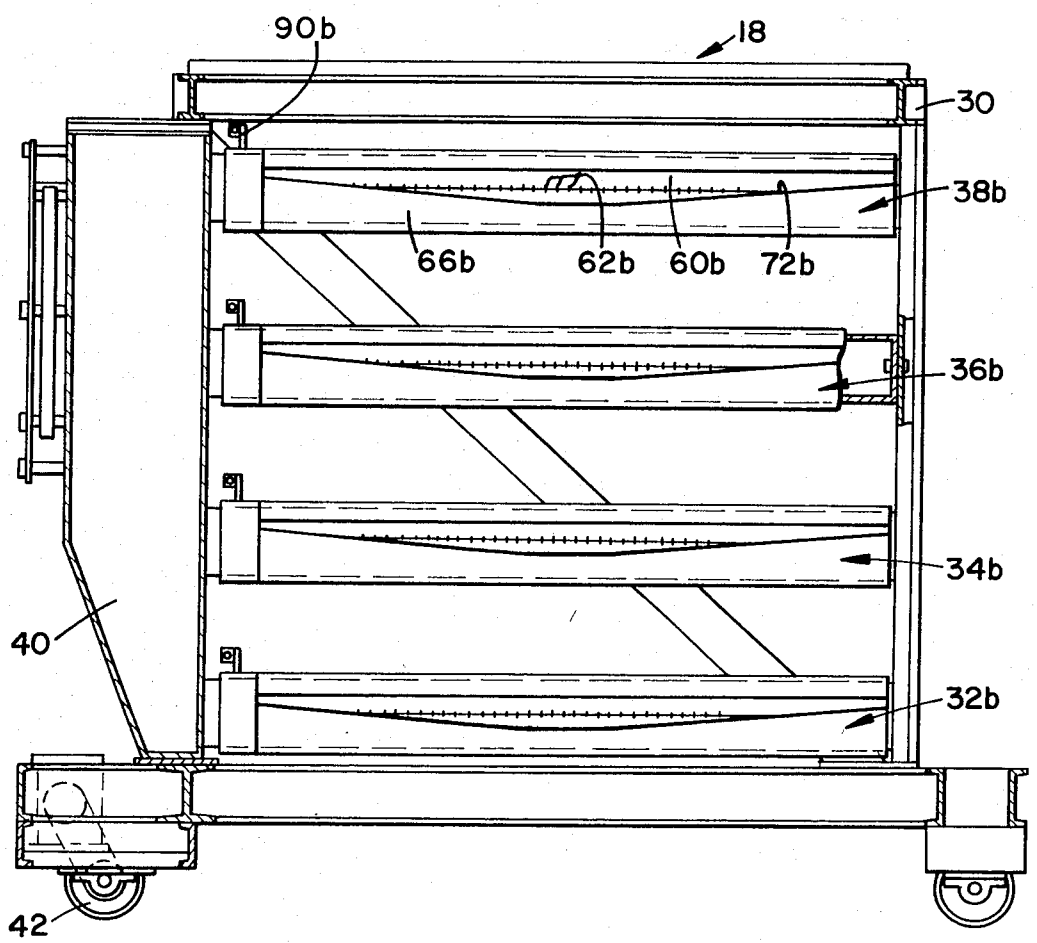
FIG. 3 is an enlarged cross-sectional view of the pre-cooling assembly taken along lines 3—3 of FIG. 2.

Referring to FIGS. 3 and 4, and with continuing reference to FIGS. 1 and 2, the pre-cooler assembly 18 includes a frame assembly 30. A plurality of pairs of nozzle means are mounted to the frame on opposite sides of work path W. Specifically, the pre-cooling assembly includes a first pair of nozzle means 32*a* and 32*b*, a second nozzle pair 34*a* and 34*b*, a third nozzle pair 36*a* and 36*b*, and a fourth or trailing end nozzle pair 38*a* and 38*b*. A manifold 40 interconnects all of the nozzle means, and, in the preferred embodiment, the manifold means interconnects the nozzle means with a source of cooling fluid, eg., cool air. It is to be appreciated, however, that the manifold may analogously interconnect the nozzle means with a source of heated fluid such that the nozzle means differentially heat the strip across its width. Further, the manifold may also connect the nozzles with an exhaust means, a source of other cooling or heating fluid, and the like.

With particular reference to FIG. 1, the pre-cooler assembly is moveably mounted such that it is selectively positionable relative to the flow path of conveyed strip 10, or such that it can be removed totally from communication with the flow path. To facilitate mobility, frame 30 includes wheels or casters 42 which roll along parallel spaced apart tracks 44. A first duct section 46 connected with manifold 40 is interconnected with a blower 48 by means of a slip fitting 50. This slip fitting enables first duct section 46 to be telescopically received in a second duct section 52 to accommodate the foregoing movement of pre-cooler assembly 18.

Figure 6:
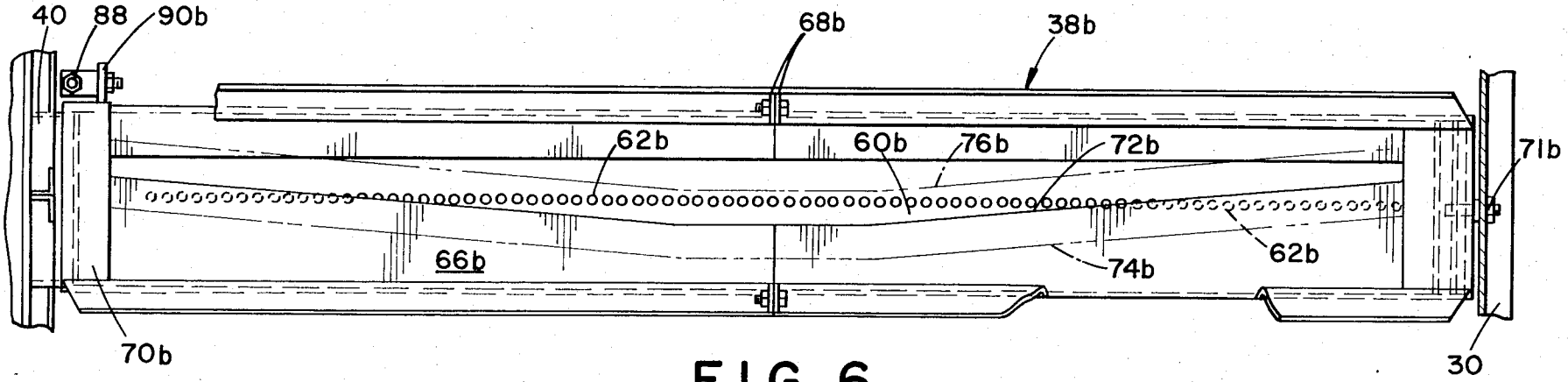
Figure 5:
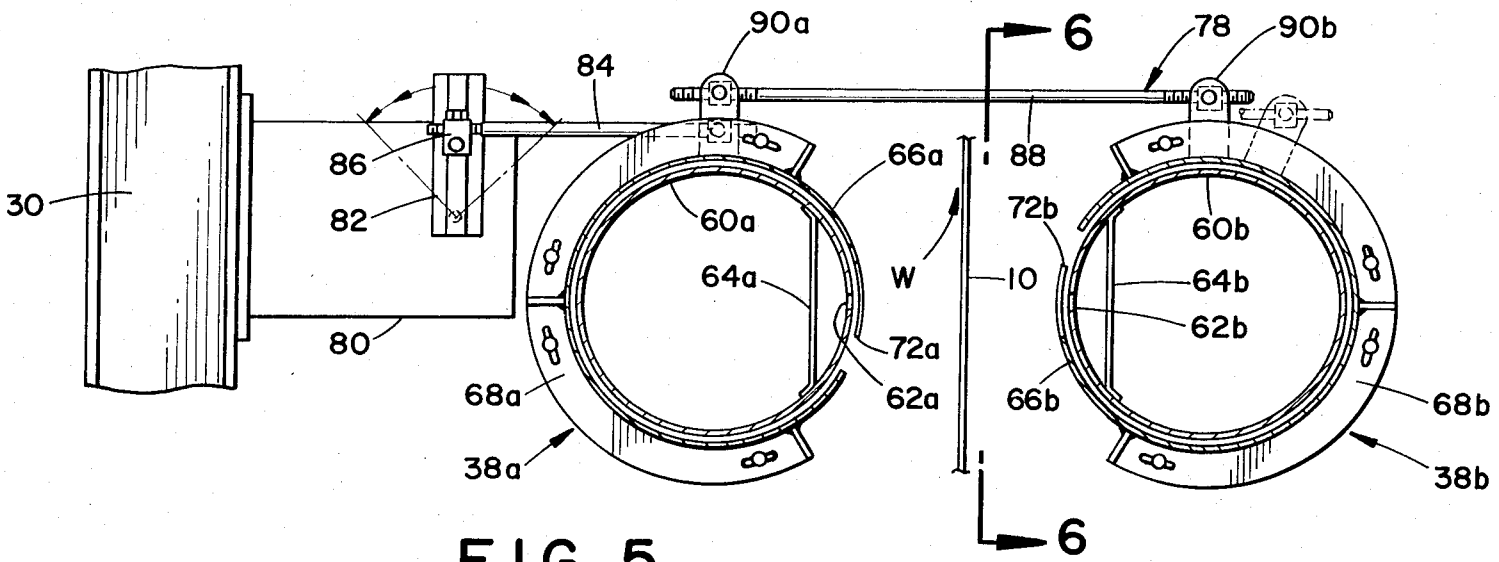
FIG. 5 is an enlarged transverse cross-sectional view of a pair of opposed nozzles of the pre-cooler assembly as shown in FIG. 4; and, FIG. 6 is a cross-sectional view taken along lines 6—6 of FIG. 5.

With particular reference to FIGS. 5 and 6, one of the nozzle pairs used in the pre-cooler assembly is shown in detail. Because each nozzle pair is of substantially the same construction, only the pair comprised of nozzles 38*a*, 38*b* is described in detail herein. However, it is to be appreciated that the other nozzle pairs are identical thereto unless otherwise specifically noted. More particularly, nozzle means 38*a*, 38*b* include fluid conducting conduits 60*a*, 60*b*, respectively, communicating with manifold 40. Conduits 60*a*, 60*b*, in turn, have arrays of apertures 62*a*, 62*b* defined therein.

In the preferred embodiment, each nozzle aperture array is linear in nature and defined by a plurality of evenly spaced circular bores. Moreover, arrays 62*a*, 62*b* are disposed on opposite sides of work path W in a facing relationship with each other transversely of the work path. Thus, fluid such as air or the like issuing from the arrays will impinge the opposite sides of strip 10 transversely thereacross. It is to be appreciated, however, that the nozzle aperture arrays may also include one or more elongated slots or other aperture shapes which permit fluid to flow therethrough as described. Perforated plates 64*a*, 64*b* are disposed behind the aperture arrays, and each plate is perforated with holes which have a total area substantially larger than the nozzle apertures. Moreover, a sufficient number of holes are included so that plates 64*a*, 64*b* are rendered approximately ten percent (10%) open.

Variable nozzle restriction means such as dampers 66*a*, 66*b* are disposed in a surrounding relationship with conduits 60*a*, 60*b*, respectively, for selectively obstructing the nozzle aperture arrays. As best shown in FIG. 6, the dampers are of a two-piece construction joined by conventional means at central flanges 68*a*, 68*b*. However, other constructions could also be satisfactorily employed without in any way departing from the invention. In the preferred embodiment, conduits 60*a*, 60*b* and dampers 66*a*, 66*b* are circular in cross-section and concentrically mounted such that each damper is rotatable about its associated conduit. As shown, one end of the damper 66*b* is sleeve mounted to conduit 60*b* adjacent manifold 40 as at numeral 70*b*. The other end is shaft mounted to frame 30 as at numeral 71*b*. Optionally, the conduits and dampers may have other relationships and/or mountings which facilitate relative sliding movement therebetween. For example, conduits 60*a*, 60*b* may have flat surfaces adjacent the nozzle apertures and the dampers 66*a*, 66*b* may be mounted to undergo linear, sliding movement relative thereto. Such modifications do not depart from the overall intent or scope of the invention.

The dampers have axial slot-like openings including leading edge portions 72*a*, 72*b* extending substantially over the lengths thereof which may be selectively moved or rotated across nozzle aperture arrays 62*a*, 62*b*, respectively, for restricting fluid passage through predetermined portions thereof. In the preferred embodiment, nozzle aperture arrays 62*a*, 62*b* are linear, and damper leading edges 72*a*, 72*b* are somewhat U-shaped with opposed, gradually sloping side portions and central portions. FIG. 6 best shows this conformation for damper 66*b*, it being understood that the other dampers are similar thereto. As damper 66*b* is rotated clockwise from the fully open position of FIG. 6, the far or outer extremes of the leading edge as designated by numeral 74*b* begin to cover apertures in array 62*b* at the outer extremes thereof. With continued clockwise rotation, the nozzle apertures spaced toward the central area of conduit 60*b* are progressively obstructed. All nozzle apertures are obstructed when the leading edge has rotated to the position designated by numeral 76*b*. When the leading edge is in an intermediate position, (i) the apertures at the far extremes are totally covered, (ii) the apertures in the central region are unobstructed, and (iii) the apertures in an intermediate region between the central region and the end region are partially obstructed.

Although nozzle arrays 62*a*, 62*b* are illustrated as being linear, and leading edges 72*a*, 72*b* are illustrated and described as being somewhat U-shaped, it is to be appreciated that other arrangements of the aperture arrays and the leading edges may achieve similar results. For example, the nozzle aperture arrays may extend along an arcuate path and the leading edges may be linear. Alternatively, both the aperture arrays and leading edges may include sloping portions. As yet another option, the leading edges may be castellated, sinusodial, or otherwise irregular, to modify the transition between open and closed nozzle aperture regions.

Nozzle means 38*a* and 38*b* are mounted with opposite ends thereof connected to manifold 40. A mechanical interconnecting means generally designated 78 conveniently interconnects the pair of dampers 66*a*, 66*b* such that they undergo coordinated movement in which each obstructs substantially the same portion of the associated array of nozzle apertures. As will be best appreciated from FIG. 6, this particular interconnecting means causes damper 66*a* to rotate downwardly to obstruct the associated nozzle aperture array 62*a*, and causes damper 66*b* to rotate upwardly to obstruct the associated nozzle aperture array 62*b*. The interconnecting means for the other nozzle means pairs are shown in FIG. 4.

Referring again to FIGS. 5 and 6, an electrical drive 80 selectively pivots a lever arm 82 which is connected by a link 84 with the damper 66*a* such that movement of lever arm 82 opens and closes the nozzle array 62*a*. An adjustable connection 86 permits selective adjustment of the effective length of the lever arm 82 to vary the relative angular displacement of the damper for a given degree of pivoting of the electrical drive and lever arm. A link 88 interconnects tabs 90*a* and 90*b* affixed to the left and right dampers such that both dampers undergo the same degree of angular displacement with movement of the lever arm. This retains the left and right dampers in a coordinated relative position.

In use, the steel strip emerging from the natural cooling area 14 along work path W has an uneven heat distribution. Most commonly, the strip is hotter in the center area and cooler adjacent the outer edges, although the exact temperature distribution will vary with thicknesses of the steel strip and coating and prior thermal treatments of the strip. In that case, the first pair of cooling nozzles 32*a*, 32*b* is adjusted so that cooling fluid issuing therefrom cools a central portion of the strip on both sides thereof. As will be appreciated, the variation in cooling capacity across the nozzle pair is frequently different from the heat distribution across the strip. Accordingly, the first nozzle pair will merely bring the strip closer to a more uniform heat distribution upon reaching second nozzle pair 34*a*, 34*b*. The nozzles of the second pair are adjusted, frequently different from the nozzles of the first pair, to bring the strip to a still more uniform temperature distribution. Similarly, the third and fourth nozzle pairs are adjusted to render the temperature distribution across the strip even more uniform.

Oftentimes, the temperature distribution can be rendered substantially uniform with four nozzle pairs. If fewer nozzle pairs are required, one or more of the pairs may be closed, or they may be fully opened to cool the strip further without affecting the temperature distribution. Similarly, if the strip does not achieve a satisfactory temperature distribution after passing through four nozzle pairs, additional pairs may be added as deemed necessary.

The invention has been described with reference to the preferred embodiment. Obviously, modifications and alterations will occur to others upon a reading and understanding of the foregoing detailed description of the preferred embodiment. It is intended that the invention be construed as including all such modifications and alterations insofar as they come within the scope of the appended claims or the equivalents thereof.

Having thus described the invention, it is now claimed:

1. A minispangling apparatus comprising:

(a) steel strip conveying means adapted for conveying a continuous strip of hot steel along a work path;

(b) a galvanizing bath of molten zinc disposed in cooperative association with the strip conveying means for coating a steel strip;

(c) a coating weight control device in cooperative association with the strip conveying means downstream of said galvanizing bath to control the coating thickness on the strip;

(d) a natural cooling area disposed in cooperative association with the strip conveying means downstream along said work path from the coating weight control device to cool the strip and coating with ambient conditions such that the coated strip emerges from the natural cooling area with a non-uniform temperature distribution in which the strip is cooler along opposite edges and warmer at a center area;

(e) a pre-cooler assembly disposed in cooperative association with the strip conveying means downstream of said work path from the natural cooling area, said pre-cooler assembly including (i) fluid nozzle means for discharging a band of fluid toward said work path generally transversely thereof and (ii) nozzle restricting means for selectively truncating the fluid band in a preselected pattern to restrict the discharge from the nozzle means non-uniformly across the work path width such that the amount of fluid discharged against a strip moving along the work path is selectively variable in accordance with the preselected restriction pattern across the strip width to effect strip cooling to a more uniform temperature distribution; and, (f) a minispangle box disposed in cooperative association with the strip conveying means downstream along said work path from the pre-cooler assembly to produce a uniform minispangle appearance on the strip coating.

2. The apparatus as set forth in claim 1 wherein the nozzle means includes a tubular conduit having an array of nozzle apertures spaced therealong and directed toward the work path, whereby fluid emitted from the nozzle apertures is adapted to impinge against a steel strip moving along the work path.

3. The apparatus as set forth in claim 2 wherein the nozzle restricting means includes a damper cooperable with the conduit for selectively blocking a selected portion of the conduit aperture array.

4. The apparatus as set forth in claim 3 wherein the conduit is substantially circular in transverse cross-section and wherein the damper has at least a portion thereof disposed along an arc segment which is concentric with the conduit, said damper being rotatable concentrically relative to the conduit.

5. A minispangling apparatus comprising:

(a) steel strip conveying means adapted for conveying a continuous strip of hot steel along a work path;

(b) a galvanizing bath of molten zinc disposed in cooperative association with the strip conveying means for coating a steel strip;

(c) a pre-cooler assembly disposed in cooperative association with the strip conveying means downstream along said work path from the galvanizing bath, said pre-cooler assembly including:

(i) a tubular conduit having an array of nozzle apertures spaced therealong and directed toward the work path, whereby fluid emitted from the nozzle apertures is adapted to impinge against a steel strip moving along the work path, (ii) a damper cooperable with the conduit for selectively blocking a preselected portion of the conduit aperture array, the damper having a leading edge which is moveably disposed relative to the aperture array, the leading edge and aperture array being configured such that as the damper and conduit undergo relative motion in a first direction, the aperture array is progressively covered from its outer extremes toward a central portion; and, (d) a minispangle box disposed in cooperative association with the strip conveying means along said work path downstream from the pre-cooler assembly to produce a uniform minispangle appearance on the strip coating.

6. The apparatus as set forth in claim 5 wherein the aperture array is substantially linear and wherein the damper leading edge is generally U-shaped such that as the aperture array and damper undergo relative movement, apertures within the array are progressively covered and uncovered.

7. A minispangling apparatus comprising:

(a) steel strip conveying means adapted for conveying a continuous strip of hot steel along a work path;

(b) a galvanizing bath of molten zinc disposed in cooperative association with the strip conveying means for coating a steel strip;

(c) a coating weight control device in cooperative association with the strip conveying means downstream of said galvanizing bath to control the coating thickness on the strip;

(d) a pre-cooler assembly disposed in cooperative association with the strip conveying means downstream along the work path from the coating weight control device, said pre-cooler assembly including:

(i) first and second nozzle arrays extending generally across the work path for discharging first and second bands of fluid, respectively, toward the work path from opposite sides thereof, and (ii) first and second dampers for selectively truncating the first and second fluid bands to restrict fluid flow through the first and second nozzle arrays, respectively; and, (e) a minispangle box disposed in cooperative association with the strip conveying means along said work path downstream from the pre-cooler assembly to produce a uniform minispangle appearance on the strip coating.

8. The apparatus as set forth in claim 7 wherein the first and second dampers are operably interconnected and disposed in analogous relationships with the first and second nozzle arrays such that corresponding portions of the first and second nozzle arrays may be selectively restricted.

9. The apparatus as set forth in claim 7 wherein the pre-cooler assembly further includes at least third and fourth nozzle arrays disposed downstream from said first and second arrays for discharging fluid toward said work path from opposite sides thereof, and third and fourth dampers associated with said third and fourth nozzle arrays, respectively, for selectively restricting fluid flow therefrom toward the work path.

* * * * *